US007086337B2

(12) United States Patent
Klein

(10) Patent No.: US 7,086,337 B2
(45) Date of Patent: Aug. 8, 2006

(54) NON-LETHAL PROJECTILE AMMUNITION

(76) Inventor: John M. Klein, 2222 McKechnie Rd., Harrisville, MI (US) 48740

( * ) Notice: Subject to any disclaimer, the term of this patent is extended or adjusted under 35 U.S.C. 154(b) by 385 days.

(21) Appl. No.: 09/966,725

(22) Filed: Sep. 28, 2001

(65) Prior Publication Data

US 2004/0069177 A1 Apr. 15, 2004

Related U.S. Application Data

(60) Provisional application No. 60/236,306, filed on Sep. 28, 2000.

(51) Int. Cl.
*F42B 8/00* (2006.01)

(52) U.S. Cl. ..... 102/502; 102/370

(58) Field of Classification Search ..... 102/502, 102/512, 370, 513, 529
See application file for complete search history.

(56) References Cited

U.S. PATENT DOCUMENTS 3,782,286 A * 1/1974 Jones et al. ..... 102/502
3,911,824 A * 10/1975 Barr et al. ..... 102/502
5,016,536 A * 5/1991 Brighton ..... 102/430
5,035,183 A * 7/1991 Luxton ..... 102/502
5,086,703 A * 2/1992 Klein ..... 102/439
5,453,451 A * 9/1995 Sokol ..... 522/42
5,565,649 A * 10/1996 Tougeron et al. ..... 102/502
6,041,712 A * 3/2000 Lyon ..... 102/439

* cited by examiner

*Primary Examiner*—Teri Pham Luu
*Assistant Examiner*—T. Nguyen
(74) *Attorney, Agent, or Firm*—The Weintraub Group P.L.C.

(57) ABSTRACT

Non-lethal ammunition for a riot gun includes a forwardly open casing, a projectile mountable in and dischargeable from the casing, a propellant cartridge extending into the casing interior, and a UV curable adhesive disposed in sealing relation about the propellant to effectuate uniform firing of the projectile. The projectile includes rearward and forward end portions each provided with a central cavity with the rearward cavity enclosing the cartridge, a weight in the forward cavity for balancing and increasing the mass of the projectile, and a subassembly carrying in a nose thereof a chemical payload or chemical agent, the subassembly including a stem sized for interference fitment within the forward cavity to secure the subassembly to the projectile and having a chamber for positioning the weight in the forward cavity.

15 Claims, 4 Drawing Sheets

FIG 4
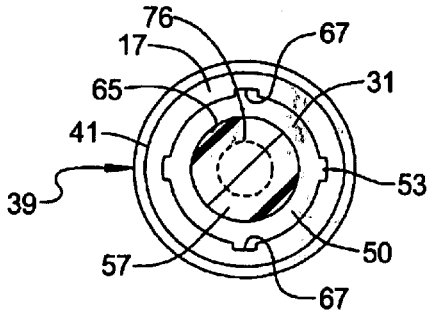
FIG 6
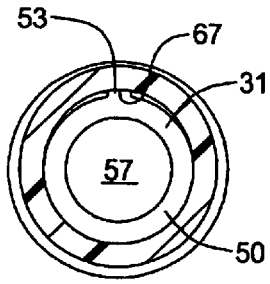
FIG 7
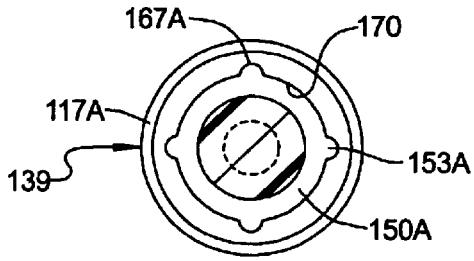
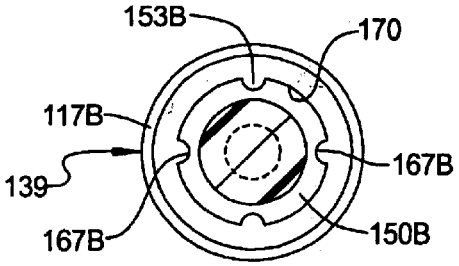
FIG 8
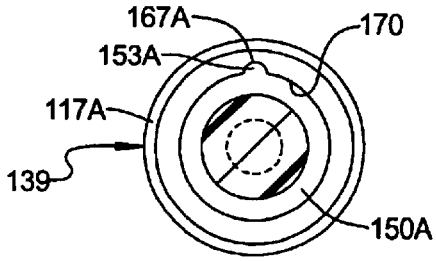
FIG 9

FIG 5
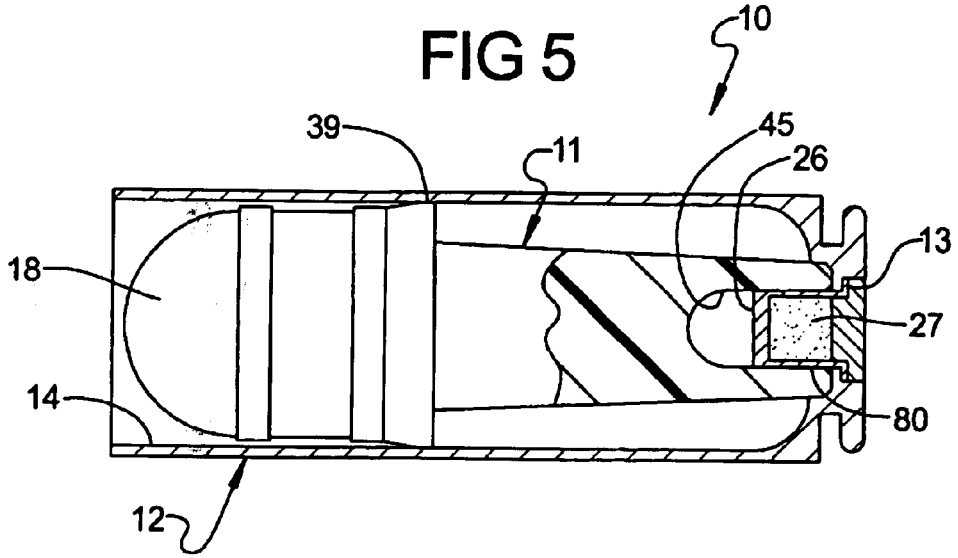
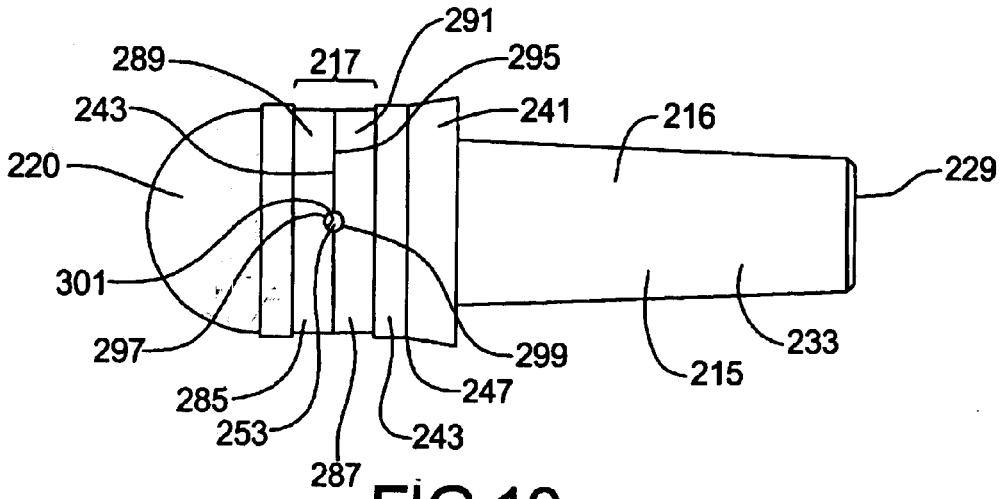
FIG 10

NON-LETHAL PROJECTILE AMMUNITION

CROSS-REFERENCE TO RELATED APPLICATIONS

This Application is a completion application and under 35 USC Section 119 (e) claims a priority date of Sep. 28, 2000 from co-pending U.S. Provisional Application Ser. No. 60/236,306, having the title "Non-Lethal Projectile Ammunition", the disclosure of which is incorporated herein by reference.

BACKGROUND OF THE INVENTION

Field of the Invention

The present invention relates to ammunition. More particularly the present invention relates to ammunition projectiles for use in hand held weapons such as riot guns. Even more particularly the present invention concerns less-lethal ammunition projectiles having improved trajectories for use in riot guns and similar firearms.

BRIEF DESCRIPTION OF THE DRAWINGS

FIG. 4 is a cross-sectional view of the ammunition projectile taken along line 4—4 of FIG. 2 and shows a cylindrical driving band mounted on a fluted end portion of the projectile body and interlocked therewith by multiple ribs and cavities.

FIG. 5 is a partial cross-sectional view of the ammunition projectile and insertion end thereof positioned in a shell casing and in relation to a propellant charge according to this invention.

FIG. 6 is a cross-sectional view of a second embodiment of an ammunition projectile according to the invention and shows the band mounted on the projectile body and interlocked therewith by a single rib and cavity.

FIGS. 7, 8 and 9 are cross-sectional views of third and fourth embodiments of an ammunition projectile according to the present invention and show a modified cylindrical driving band interlocked with the forward end portion of the projectile body by nubs and depressions.

FIG. 10 is a side elevation view of a fifth embodiment of an ammunition projectile according to the present invention and shows a nub being retained by a split ring.

DETAILED DESCRIPTION OF THE INVENTION

Figure 1:
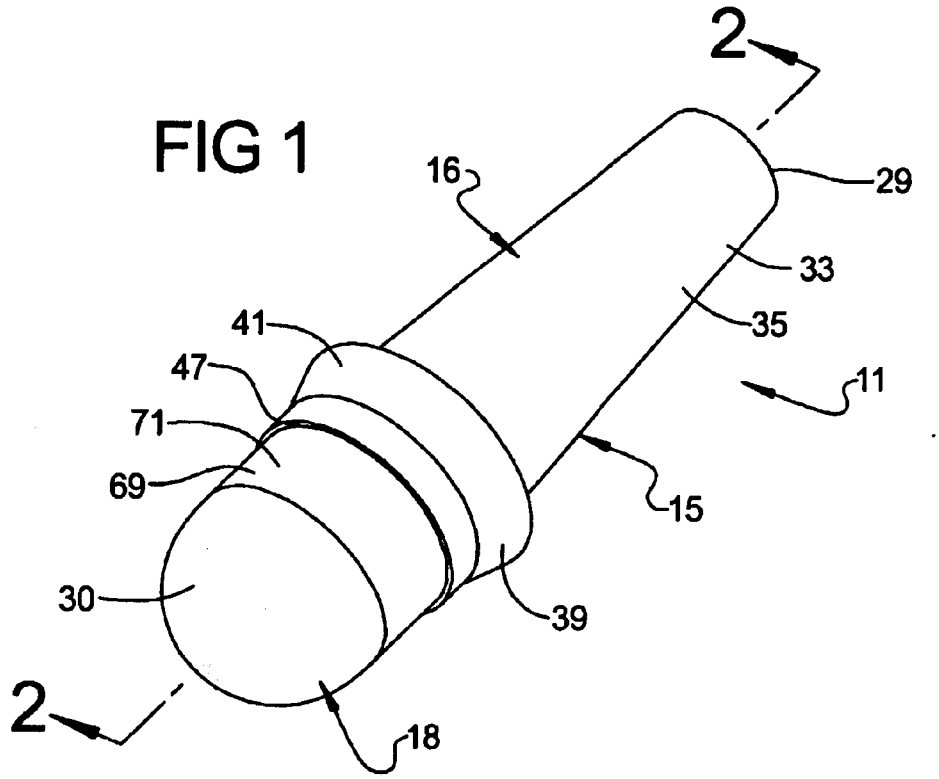
FIG. 1 is a perspective view of an ammunition projectile in accordance with the present invention.
Figure 2:
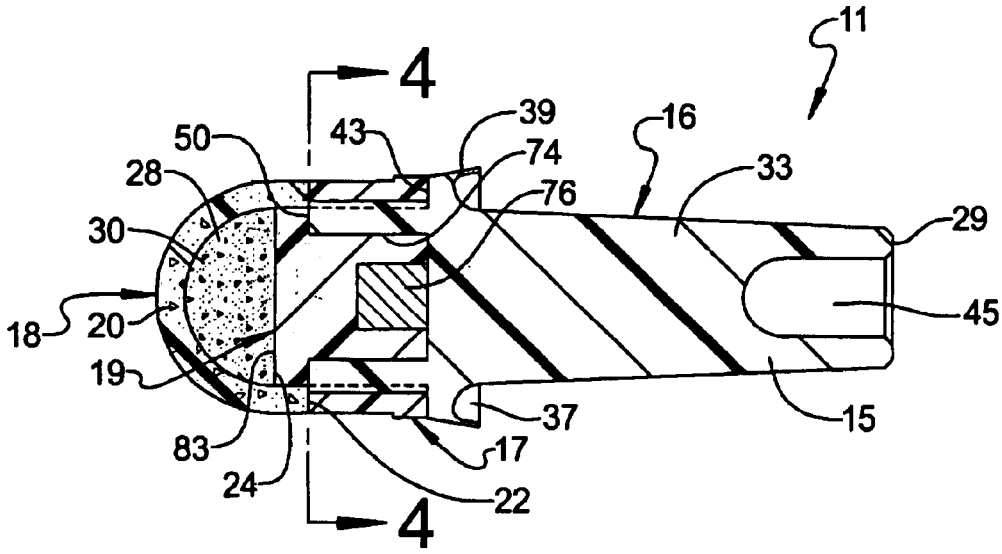
FIG. 2 is a cross-sectional view of the ammunition projectile taken along line 2—2 of FIG. 1.
Figure 3:
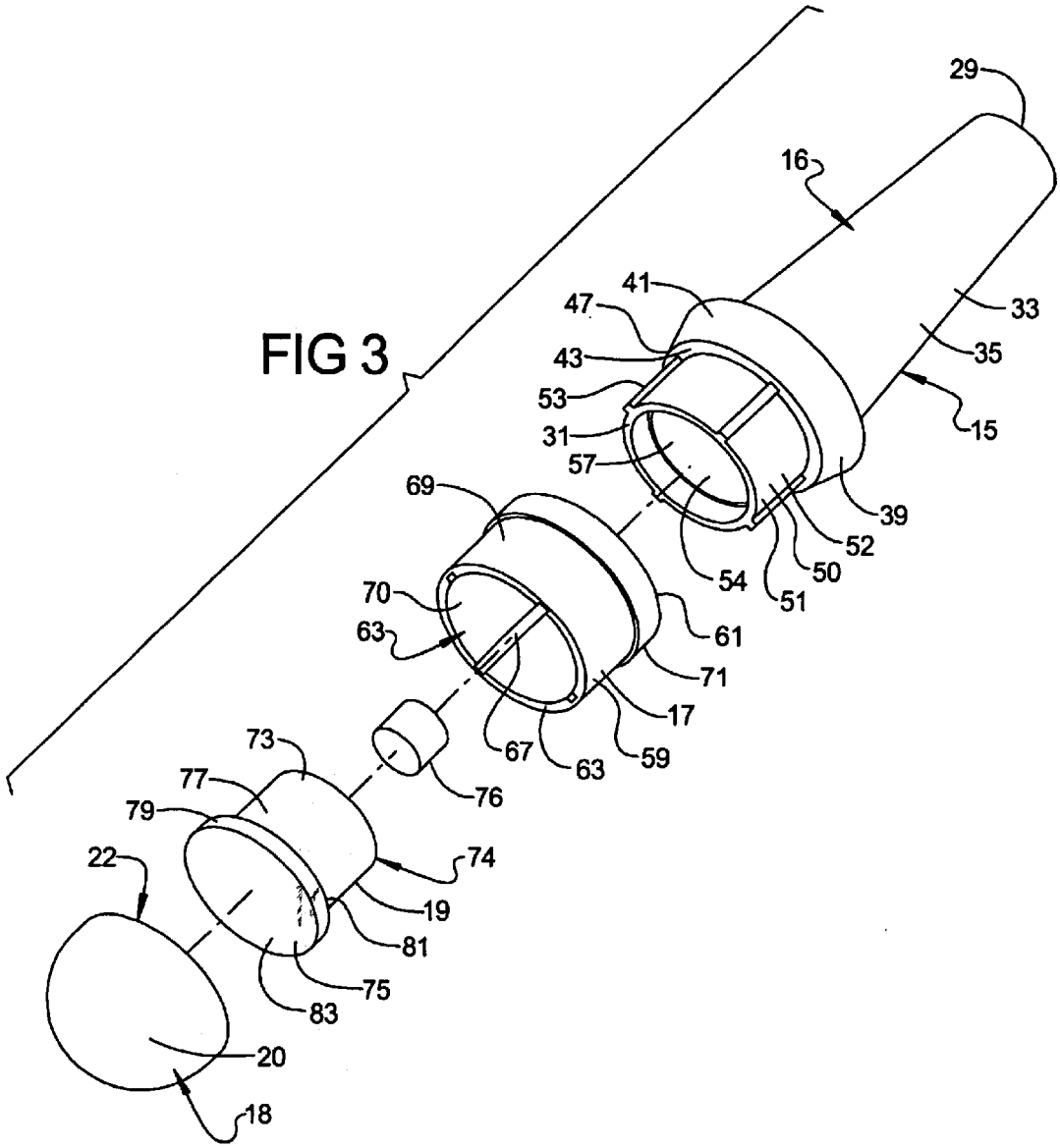
FIG. 3 is an exploded perspective view of the ammunition projectile of FIG. 1.

With reference to the drawing, and, in particular, FIGS. 1–5, in accordance herewith there is provided universal projectile ammunition of the instant invention and generally denoted at 10. The universal projectile ammunition 10 includes an ammunition projectile 11 that is mounted in a shell casing 12. Preferably, the ammunition projectile 11 is employed as non-lethal or less-lethal ammunition, such as in riot control guns, etc.

As is well known in the art, such a shell casing 12 is a hollow tubular structure made of metal, such as aluminum or the like. The casing 12 has a propelling charge loading orifice 13 in the rearward interior end wall thereof and a payload expelling end 14. The casing 12 maintains strict compliance with the caliber or size requirement of a weapon or firearm (not shown) used to fire the ammunition projectile 11. Also, the casing 12 houses the entire ammunition projectile 11, which is inserted into the payload expelling end 14 of the casing, and a propelling charge 27 for the projectile proximate the orifice 13. Such a construction is well known in the art, such as is disclosed in U.S. Pat. No. 5,086,703, the disclosure of which is hereby incorporated by reference.

As shown, the ammunition projectile 11, generally, comprises:

(a) a projectile body 15 having forward and rearward end portions 50 and 16, the rearward end portion 16 including a propellant charge cavity 45;

(b) a cylindrical driving band 17 mounted on the forward end portion 50;

(c) a protuberance 53 or 153A or 153B and depression 67 or 167A or 167B on one and the other of said forward end portion and said band, the protuberance engaged with the depression to prevent relative rotation therebetween;

(d) an insert member 19 interlocked with the forward end portion 50 of the projectile body;

(d) a weight 76 disposed within the insert member for balancing and increasing the mass of the projectile body; and (e) a nose 18 fixedly mounted to the insert member 19, the nose and the insert member defining an interior cavity in which a payload such as a chemical agent 28 and/or marking powder 30 is held.

The projectile body 15 hereof, which is mounted into the shell casing, is axially elongated, and includes rearward and forward end portions or legs 16 and 50 and a medial collar 39, the legs and collar being concentrically disposed about a central longitudinal axis through the projectile. The rearward leg 16 defines an inserting or insertion end of the projectile and is formed by a tapered wall 33 that generally uniformly reduces in diameter in proceeding from the collar 39 to the rearward end 29 of the leg 16.

The propellant charge cavity 45 is generally cylindrical, concentrically aligned with the longitudinal axis, and extends axially inwardly from the rearward end 29 and into the body of the rearward leg 16.

The forward leg 50 defines an issuing end of the projectile and is formed by a cylindrical wall 52 that extends axially from the collar 39 to a forward end 31. The cylindrical wall 52 has an exterior surface 51, an interior surface 54, and defines a cylindrical central cavity 57 in the forward leg 50. The cylindrical wall 52 and the surfaces 51 and 54 thereof are concentric with the longitudinal axis of the projectile body 15. At least one, and preferably a plurality of protuberances, extend radially outwardly from the exterior surface 51.

In the embodiment shown in FIGS. 1–5, the protuberances comprise four ridges or ribs disposed equiangularly about the exterior surface 51. Each ridge or rib is generally linear, elongated, and extends radially outwardly from the cylindrical wall 52 and axially between the forward end 31 and the medial collar 39.

The propelling charge 27 generally comprises an explosive such as gunpowder or the like and a primer. Preferably, the propelling charge 27 is disposed in a cartridge 80 or the like with the expelling end of the cartridge and the propellant adjacent thereto being sealed.

Significantly and according to an important aspect of this invention hereto, it has been found that a sealant adhesive is advantageously employed to effectuate an appropriate and requisite seal of the propellant. Absent such sealing, non-uniformity in the firing of one projectile to another may be encountered.

In the practice of the present invention it has been found that a particularly preferred adhesive, indicated generally by the number 26 in FIG. 5, is a UV or ultraviolet light curable adhesive. Ultraviolet light (UV) curable adhesives are known and, generally, comprise a mixture of a UV curable composition and a photoinitiator, which when exposed to an energy source, such as ultraviolet light, causes a cross-linking reaction to be effected, which cross-linking reaction creates a polymeric adhesive which seals the cartridge.

A particularly preferred UV curable composition for use herein comprises a mixture of UV curable acrylates of the type, which are well known and commercially available, and a photoinitiator. These acrylates and photoinitiators are well described in the literature. See, inter alia, U.S. Pat. No. 5,453,451 the disclosure of which is hereby incorporated by reference.

In the practice of the present invention it has been found that a particularly preferred UV curable polymeric adhesive is that sold by Loctite Corporation under the name Loctite 3105 which is described as a mixture of an aliphatic urethane acrylate oligomer, high bonding acrylate hydroxyalkyl methacrylate, a silica filler and a photoinitiator.

In sealing the propellant a sufficient quantity of the adhesive mixture 26 is deposited over the propellant charge 27 and thereafter is exposed to an energy source, such as an ultraviolet light lamp, which initiates the cross linking reaction thereby forming the polymeric adhesive seal over the propellant. Ordinarily, an exposure time of about 5 to 15 seconds is needed to effectuate the appropriate seal.

After the seal is emplaced, the cartridge 80 is inserted into and seals the orifice 13 formed in the end wall of the shell casing 12. The rearward leg 16 or insertion end 29 of the projectile body 15 is inserted into the shell casing 12, the cavity 45 thereof positioned in enclosing relationship about the cartridge 80, and the end 29 of the leg 16 positioned at the end wall of the shell casing.

The tapered wall 33 of the rearward end portion 16 has an outside surface 35 that is generally frusto-conically shaped to aid in the balance and airflow of the projectile, and to prevent tumbling of the projectile in flight. The outside surface 35 begins at the insertable rearward end 29 of the projectile body 15 and tapers radially outwardly when proceeding forwardly toward the circumferential medial collar 39.

The medial collar 39 is integrally formed with and located between the opposite ends 31 and 29 of the projectile body 15. The collar 39 extends radially outwardly from the projectile body 15 and cooperates with the outside surface 35 of the rearward leg 16 to form a skirt and a rearwardly opening annular cavity 37. The annular cavity 37 and the skirt act as an obturating surface in that the skirt inflates outward, upon firing, into engagement with and against the inner wall of the expelling end 14 of the shell casing 12 to prevent propelling gases from leaking therepast and, thus, forms a circumferential seal.

The medial collar 39 comprises a tapered circumferential surface wall 41 and a flat annular land or shoulder or check line extension 43, the annular land being disposed in a plane substantially normal to the central longitudinal axis of the projectile body 15 and extending between the tapered surface wall 41 of the collar and the cylindrical wall 52 of the forward leg 50. A junction 47 is formed between the surface wall 41 and the annular land 43. The circumferential surface wall 41 tapers radially outwardly and rearwardly from the junction 47 toward the rearward end 29 to overlay the annular cavity 37 and to define the skirt for the annular cavity 37.

Referring to FIGS. 1–4, the driving band 17 is cylindrical and slidably fits onto and about the forward cylindrical wall 52 of the forward leg 50. The annular land 43 defines a stop or an inward limit for positioning the cylindrical driving band 17 relative to the leg 50.

As subsequently detailed, the exterior surface 51 of the wall 52 has at least one ridge 53 to engage with a corresponding cavity or depression 67 formed in a cylindrical inner surface 70 of the driving band 17. In FIGS. 1–4, the projectile 11 is shown as having four ridges or axial ribs 53 arranged equiangularly about the exterior surface 51 of the leg 50 interlocking with four like cavities or depressions 67 formed in the driving band 17. The ridges 53 cooperate with the cavities 67 to interlock the driving band 17 relative to the projectile body 15.

Preferably, the driving band 17 is made from a flexible non-metallic material, such as nylon, polyurethane elastomer, a combination of both, or a soft metallic material such as copper or brass.

The driving band 17 is a hollow, cylindrical member 59 with a rearward first end 61, a forward second end 63, a cylindrical outer surface 69, and the cylindrical inner surface 70. The driving band 17 has a fluted internal through bore 65 extending between the first and second ends 61 and 63 and through the cylindrical member 59.

The cylindrical inner surface 70 has an equal number of cavities 67 corresponding to and matingly engageable with an associated ridge 53 on the projectile body 15. The ribs ridges 53 of the projectile body 15 and the cavities 67 in the driving band 17 may be of any desired configuration, so long as the configuration of the ridge 53 and associated cavity 67 correspond to each other to achieve interlocking engagement therebetween. While four ribs and cavities 53 and 67 are shown arranged at 90° to one another, the number and angular arrangement could be other so as to enable only selected driving bands 17 to be mounted to the leg 50. At least one rib and cavity is necessary to interlock the band 17 to the projectile body 15 whereby to prevent the band 17 from rotating independently from the projectile body 15 during firing.

The outside surface 69 of the driving band 17 has a collar 71 circumferentially disposed about the second end 63 of the rotating or driving band 17. The collar 71 acts as a rotating band to engage a rifled barrel.

The insert member 19 closes the driving band 17 at the forward second end 63 thereof The insert member 19 seals the cavity 57 of the leg 50, retains the driving band 17 in place on the body 15, captivates the weight 76 in a chamber 74 thereof and positions the weight in the projectile body, and assists in the definition of the type of ammunition defined by the projectile body 15.

The insert member 19 is, preferably, made from a non-metallic material, such as an elastomer, foam rubber, synthetic rubber or the like and has the shape of a bottle closure cap and has two ends, including a stem end 73 and a cap end 75.

The stem end 73 comprises a cylindrical stem 77 extending centrally from the cap end 75. The stem 77 has a diameter that is slightly greater than the diameter of the cavity 57 such that a frictional press fit retaining engagement force is developed between the outer surface of the stem and the interior surface 54 of the cavity 57.

The cap end 75 includes a cylindrical cap 79 with a first flat or planar side 81 and a second flat or planar side 83. The diameter of the cap 79 is larger than the diameter of the stem 77, but smaller than the diameter of the second end 63 of the band 17. The first flat side 81 of the cap 79 seats against or is in proximity to the annular second end 63 of the band 17 to enclose the cavity 57. When the stem 77 is inserted into the cavity 57, the cap end 75, therefore, seals the cavity 57. The cap 79 does not completely cover the second end 63, i.e., the cap outer circumference is not greater the then outer diameter of the wall 52.

The stem end 73 has a depression or axial chamber 74 formed centrally within it at the end opposite the cap end 75. The weight 76 is removably disposed within the chamber 74 and aids in balancing and achieving a desired weight of the projectile 11 and in preventing tumbling of the projectile in flight. Preferably, the weight 76 is made from lead or another material with a similarly large ratio of weight to size.

The nose 18 is formed, preferably, from styrofoam. The nose 18 is a concave or U-shaped element or hollow body 20. In the embodiment shown, the nose is depicted as a generally hemispherically shaped dome or shell. The hollow body 20 includes a shaped wall 21 having a dome-shaped interior surface 25 that terminates in an annular end face 22 and forms an outwardly open interior chamber. The wall surface 25 of the interior chamber includes a cylindrical annular surface 23 circumjacent to the annular end face 22 thereof, the annular surface 23 having a diameter that is slightly less than the outer diameter of the cap 75 to form a locking interference fitment therewith and form a closed payload chamber. The outer diameter of the body 20 circumjacent to the open end of the nose 18 is preferably substantially the same as, or slightly less than, the outer diameter of the second end 63 of the driving band 17.

A chemical agent 28, preferably a powdered chemical agent, such as tear gas or the like, may be inserted into the payload chamber formed by the interior chamber of the nose and the second flat or planar end face 83 of the cap end 75. A marking powder 30 may be mixed with the chemical agent 28, as desired.

In assembling the projectile 11, the chemical agent 28 is inserted into the payload hollow formed by the shaped body 20 of the nose 18. The annular surface 23 of the nose 18 is press-fitted and sealed around the cap 75 of the insert member 19. The weight 76 is assembled to the chamber 74 of the insert member 19, if not integrally formed with the material thereof. This subassembly is then secured to the leg 50, the cap 75 being urged toward and against the second end 63 of the driving band 17 simultaneously with the stem 77 being press fitted into the cavity 57.

In use, in order to fire the ammunition 11, the ammunition is loaded into the shell casing 12, which is pre-loaded with the sealed propelling charge 27. Upon firing, the projectile 11 is issued from the casing in the well-known manner.

The nose 18 is rounded to reduce air resistance during flight but of adequate stiffness that air pressure during flight will not substantially alter its shape, thereby resulting in the flight trajectory being compromised. Preferably, the nose is made of a compliant material, such as styrofoam or the like, which is at least breached, if not destroyed, upon impact after firing. When the nose 18 is breached upon impact, the chemical agent 28 within the hollow body 20 is free to disperse on or around the point of impact, thus providing a potent cloud of chemical powder, which is intended to be ingested and/or to irritate certain processes of the human body, such as the lachrymal.

In a second embodiment, FIG. 6 shows the projectile 11 as having a single cavity 67 and a single fluted ridge 53. It is to be appreciated that the number of cavities and ridges may vary as desired. In all other respects, the second embodiment is similar to the first embodiment of FIGS. 1–5.

In a third embodiment, and as shown in FIGS. 7–9, in a fashion similar to that of the rib 53 and cavity 67 of the first embodiment, at least one nub or ball and a corresponding depression operate between the cylindrical band and the issuing end of the second leg to prevent relative rotation therebetween, and also to lock the band to the leg. Preferably, the cylindrical band of these embodiments is comprised of a flexible polymeric material.

In FIG. 7, four circumferentially disposed nubs or balls 153A, are formed integrally with the second leg 150 of the projectile body 15 and project radially outwardly therefrom. Similarly, four circumferentially disposed depressions 167A are formed on the inner surface of a driving band 117A and arranged to removably receive and seat the associated nubs 153A. The nubs 153A and depressions 167A cooperate to lock the driving band 117A to the second leg. Any number of cooperating nubs 153A and depressions 167A may be used.

FIG. 8 illustrates an embodiment wherein a single nub 153A and depression 167A are used.

FIG. 9 is similar to that shown in FIG. 7, except that the nubs and depressions are reversed. In particular, four circumferentially disposed nubs or balls 153B are formed on the inner surface of a driving band 117B and project radially inwardly therefrom, and four circumferentially disposed depressions 167B are formed on the outer surface of the second leg 150 and arranged to receive and seat the associated nubs 153B. The number and arrangement of the nubs and depressions could be changed.

In assembling the projectile 11, the cylindrical driving band 117A or 117B is slid onto the projectile body 15, whereupon the driving band is elastically radially expanded by sliding engagement with the at least one ball 153A or 153B until the ball reaches and seats within the associated at least one depression 167A or 167B, thereby interlocking the driving band 117A or 117B to the projectile body 15. In all other respects, the third and fourth embodiments are similar to the first embodiment of FIGS. 1–5.

In a fifth embodiment, and as shown in FIG. 10, a nub or ball 253 is formed integrally with the second leg 50 of the projectile body 15 and projects radially outwardly therefrom. A split ring 217 comprises two cylindrical ring members 285 and 287, each made of a flexible material such as synthetic rubber or the like. Each of the two portions 285 and 287 of the split ring 217 has a cylindrical body 289 and 291, respectively, terminating in an edge 293 and 295, respectively. A cutout portion 297 and 299 is formed in the edge 293 and 295, respectively. The cutout portions 297 and 299 of the two ring members 297 and 299 cooperate to form an aperture 301 when the members are aligned and abutted. The nub or ball 253 is dimensioned to fit into the aperture 301 and frictionally engage the split ring 217.

In use, the two portions 285 and 287 of the split ring 217 are aligned so as to form the aperture 301 and are slid onto the second leg 50 of the projectile body 15 until the nub or ball 253 fits into the aperture 301. In all other respects, the fifth embodiment is similar to the first embodiment of FIGS. 1–4.

While the invention has been illustrated and described in detail in the drawings and the foregoing description, the same is to be considered as illustrative and not restrictive in character, it being understood that only the preferred embodiment has been shown and described fully and that all changes and modifications that come within the spirit of the invention are desired to be protected.

What is claimed is:

1. A non-lethal ammunition projectile, comprising:

a projectile body removably emplaceable within a shell casing, the body including a forward leg having a forward end portion for mounting a payload, a rearward leg having a first chamber for receiving a propellant, and a medial collar exteriorly configured for sealing engagement with the casing wall when the projectile is in the casing, the forward end portion defining a second chamber and having an interior wall, and the forward end portion, the legs, and the collar being generally cylindrical and concentrically disposed along a central longitudinal axis, a mass disposed within the forward end portion for balancing the projectile and inhibiting tumbling of the projectile in flight, and a payload subassembly removably emplaceable within the forward end portion, the payload subassembly comprising a closure member of resilient material, a nose member, and a payload, the closure member including a stem sized to frictionally engage the interior wall of the forward end portion and having a third chamber to receive the mass whereby to position the mass along the central longitudinal axis, and a cylindrical cap sized to close the forward end of said second chamber, and said nose member being dome-like and connectible in an interference fit to the cap whereby to form a fourth chamber within which the payload is received.

2. The ammunition as claimed in claim 1, wherein the nose includes an annular surface of a diameter slightly less than the outer diameter of said cylindrical cap, wherein the nose is frictionally secured to the cap.

3. The ammunition as claimed in claim 1, wherein the nose is comprised of a compliant material that resists deformation during flight but is readily breached upon impact whereby to disperse the payload around the point of impact.

4. The ammunition as claimed in claim 3, wherein the nose is comprised of Styrofoam.

5. The ammunition as claimed in claim 1, wherein the closure member is comprised of foam rubber.

6. The ammunition as claimed in claim 1, further comprising:

a cylindrical band fitted about the exterior of the forward end portion, the band having an interior surface and a contoured exterior surface for guiding the projectile in the air, and at least one mating protuberance and depression operating, respectively, between the interior surface of the band and the outer exterior surface of the forward end portion to resist relative rotation therebetween.

7. The ammunition as claimed in claim 6, wherein the protuberance extends radially outwardly from the outer exterior surface of the forward end portion and the depression extends into the interior surface of the cylindrical band, whereby to prevent relative rotation therebetween.

8. The ammunition as claimed in claim 6, wherein the protuberance extends radially inwardly from interior surface of the cylindrical band and the depression extends inwardly of the exterior surface of the forward end portion, whereby to prevent relative rotation therebetween.

9. The ammunition as claimed in claim 6 wherein the protuberance and depression are axially elongated.

10. The ammunition as claimed in claim 6, wherein the cylindrical band is comprised of a resilient deformable material, the protuberance and depression are generally hemispherically shaped, coaxial insertion of the cylindrical band about the forward end portion operating bring the protuberance into engagement with and force the band outwardly until seating fitment of the protuberance within the depression.

11. The ammunition as claimed in claim 1, further comprising:

a cylindrical band fitted about the exterior of the forward end portion, the band forming a contoured exterior surface for guiding the projectile in the air, said band comprising first and second cylindrical ring portions each having a cutout along an end face thereof, the end faces being abutted and the cutouts brought into registry whereby to form an aperture, and at least one mating protuberance extending radially outwardly from the forward end portion for fitment within the aperture to resist relative rotation therebetween.

12. The ammunition as claimed in claim 11, wherein said ring portions are comprised of a flexible elastomeric material.

13. A universal projectile ammunition, comprising:

a shell casing having a primer and propellant receiving end, a central casing wall defining a central chamber, and a payload expelling end, a projectile body within the casing having a first leg disposed proximate to the primer end, a second leg proximate to the expelling end, and a medial closure collar which seals the central chamber, the first leg having a detonation chamber therein, and the second leg defined by a cylindrical wall having at least one longitudinally extending rib thereon and forming a central cavity, a cartridge containing propellant extending into the propellant receiving end and into enclosed relation with the detonation chamber, the propellant and the expelling end of the cartridge being sealed by a sealant adhesive comprising a mixture of an ultraviolet light curable acrylate composition and a photo-initiator, a cylindrical sleeve mounted onto the second leg, the sleeve having at least one longitudinally extending axial cavity therein, the axial cavity receiving the rib therein, a resilient closure cap having a stem frictionally engaged with the wall of the central cavity and a cylindrical cap disposed in closing relation with the central cavity, a mass retained within a central recess of the stem and positioned proximate to the central collar, a dome-shaped nose of resilient material frictionally engaged with the outer circumference of the cylindrical cap, whereby to form a chamber within which the payload is disposed.

14. The ammunition as claimed in claim 13, wherein the acrylate comprises a mixture consisting essentially of aliphatic urethane acrylate oligomer, high bonding acrylate hydroxyalkyl methacrylate, the sealant further comprising a silica filler photo-initiator.

15. The ammunition as claimed in claim 14, wherein the closure cap, mass, dome shaped nose, and payload comprise a subassembly that is assembled to the projectile body.

* * * * *